US007250005B2

(12) United States Patent
Wood et al.

(10) Patent No.: US 7,250,005 B2
(45) Date of Patent: Jul. 31, 2007

(54) GOLF CLUB LENGTH FITTING SYSTEM

(75) Inventors: Donald C. Wood, Temecula, CA (US); Andrew R. Rothman, Costa Mesa, CA (US)

(73) Assignee: Roger Cleveland Golf Company, Inc., Huntington Beach, CA (US)

( * ) Notice: Subject to any disclaimer, the term of this patent is extended or adjusted under 35 U.S.C. 154(b) by 0 days.

(21) Appl. No.: 11/540,635

(22) Filed: Oct. 2, 2006

(65) Prior Publication Data

US 2007/0026957 A1 Feb. 1, 2007

Related U.S. Application Data

(62) Division of application No. 10/748,669, filed on Dec. 31, 2003, now abandoned.

(60) Provisional application No. 60/437,048, filed on Dec. 31, 2002.

(51) Int. Cl.
*A63B 53/00* (2006.01)
*A63B 57/00* (2006.01)

(52) U.S. Cl. ..... 473/282; 473/409

(58) Field of Classification Search ..... 473/407, 473/409, 239, 282
See application file for complete search history.

(56) References Cited

U.S. PATENT DOCUMENTS 3,637,218 A 1/1972 Carlino
3,700,244 A 10/1972 Liota
3,759,527 A 9/1973 Witherspoon
4,067,572 A 1/1978 Coleman
4,725,062 A 2/1988 Kinney
4,776,594 A 10/1988 Rango
5,026,064 A 6/1991 Novosel
5,524,895 A 6/1996 Nakajima
6,383,086 B1 5/2002 Flood
6,793,587 B2 * 9/2004 Llewellyn et al. ..... 473/242
2002/0061789 A1 5/2002 Yim
2004/0023725 A1 2/2004 Llewellyn et al.
2005/0070369 A1 3/2005 Wohldorf

OTHER PUBLICATIONS

Ellis, Jeffrey B., "The Golf Club—400 ears of the Good, the Beautiful & the Creative," 2003, pp. 175, 176, and 187, Zephyr Productions, Inc., Oak Harbor, WA.

* cited by examiner

*Primary Examiner*—Stephen Blau
(74) *Attorney, Agent, or Firm*—Steptoe & Johnson LLP

(57) ABSTRACT

A method and apparatus for prescribing overall club length for iron-type golf clubs for an individual player wherein the method comprises measuring the erect height (PH) of a player to be fitted, providing the player with a fitting ball club (FBC) having a spherical ball with a hosel bore therein, one end of a golf club shaft in the hosel bore and a golf club grip on the other end of the shaft, having the player hold the fitting ball club in address position as if about to hit a golf ball therewith, measuring the wrist-to-floor distance (WFM) vertically from the player's higher wrist to the floor, locating in the first two columns of the FIG. 4 table data corresponding to the PH and WFM measurements, respectively, for the player, deriving an incremental length LCC from the third, length control club column of FIG. 4, and adding that incremental LCC length to 37-½ inches, thereby giving a prescribed overall club length for that player.

3 Claims, 6 Drawing Sheets

| PLAYER HEIGHT | WRIST TO FLOOR MEASUREMENT | LENGTH CONTROL CLUB |
|---|---|---|
| 5'0–5'7 | 28.5 UNDER | −0.5 |
| | 29–30 | 0 |
| | 30.5–31.5 | 0 |
| | 32+ | 0 |
| 5'8–5'9 | 28.5 UNDER | −0.5 |
| | 29–32 | 0 |
| | 32.5–33.5 | 0.5 |
| | 33.75+ | 0.75 |
| 5'10 | 29–32 | 0 |
| | 32.5–33 | 0.5 |
| | 33.5–33.75 | 0.75 |
| | 34+ | 1 |
| 5'11 | 29–32 | 0 |
| | 32.5–33 | 0.5 |
| | 33.5–33.75 | 0.75 |
| | 34+ | 1 |
| 6'0–6'2 | 29–31.5 | 0 |
| | 31.75–32.5 | 0.5 |
| | 32.75–33.25 | 0.75 |
| | 33.5+ | 1 |
| 6'3–6'4 | 29–30 | 0 |
| | 30.5–31.5 | 0.5 |
| | 31.75–32.5 | 0.75 |
| | 32.75+ | 1 |
| 6'5 UP | 29–30 | 0.5 |
| | 30.5–31.5 | 0.75 |
| | 31.75 UP | 1 |

| PLAYER HEIGHT | WRIST TO FLOOR MEASUREMENT | LENGTH CONTROL CLUB |
|---|---|---|
| 5'0–5'7 | 28.5 UNDER | –0.5 |
| | 29–30 | 0 |
| | 30.5–31.5 | 0 |
| | 32+ | 0 |
| 5'8–5'9 | 28.5 UNDER | –0.5 |
| | 29–32 | 0 |
| | 32.5–33.5 | 0.5 |
| | 33.75+ | 0.75 |
| 5'10 | 29–32 | 0 |
| | 32.5–33 | 0.5 |
| | 33.5–33.75 | 0.75 |
| | 34+ | 1 |
| 5'11 | 29–32 | 0 |
| | 32.5–33 | 0.5 |
| | 33.5–33.75 | 0.75 |
| | 34+ | 1 |
| 6'0–6'2 | 29–31.5 | 0 |
| | 31.75–32.5 | 0.5 |
| | 32.75–33.25 | 0.75 |
| | 33.5+ | 1 |
| 6'3–6'4 | 29–30 | 0 |
| | 30.5–31.5 | 0.5 |
| | 31.75–32.5 | 0.75 |
| | 32.75+ | 1 |
| 6'5 UP | 29–30 | 0.5 |
| | 30.5–31.5 | 0.75 |
| | 31.75 UP | 1 |

FIG.4

GOLF CLUB LENGTH FITTING SYSTEM

REFERENCE TO RELATED APPLICATIONS

This application is a divisional application Ser. No. 10/748,669 filed Dec. 31, 2003, now abandoned, which claims the benefit of U.S. provisional patent application Ser. No. 60/437,048, filed Dec. 31, 2002, the entire disclosure of which is incorporated by reference herein.

BACKGROUND OF THE INVENTION

The present invention comprises a system and method for custom fitting the length of iron-type golf clubs for a golfer.

Traditionally there have been four ways to fit golf club length for a golfer. First, the golfer might simply accept an arbitrary standard club length for his or her general physique. Second, the golfer might select a club length based on trial and error. Third, the golfer might follow the suggestion of an expert. And fourth, the golfer might determine club length by a statistical method, such as referral to charts, tables or other computations.

One such statistical method for determining club length provides a table showing correlation between a player's height and the player's wrist-to-floor measurement. However, such method has the disadvantage of not taking into consideration that golfers vary their posture, both while addressing a ball and during the swing, often independently of their physical dimensions. As a result, in this system two people who initially exhibit the same measurements, may require different club lengths because one is crouched over the ball more, or has more tilt from the waist, than the other, i.e., their address and swing positions are substantially different. Thus there is a need for more effective systems for determining the desired length of iron-type golf clubs for each individual player.

SUMMARY OF THE INVENTION

The present invention comprises a fitting system for prescribing desired length of iron-type golf clubs. This system utilizes a fitting ball club and a fitting chart comprising data in columnar forms comprising Player Height (PH), Wrist-to-Floor Measurement (WFM), and Length of Control Club (LCC). PH is a tabular listing of a plurality of possible ranges of heights, while standing erect, of a golfer to be fitted. WFM is a tabular listing of sets of possible WFMs, each set corresponding to one of the PH ranges, wherein each set of WFMs is a plurality of possible distances between a predetermined point on a wrist of a golfer and a point vertically beneath the wrist on a floor on which the golfer is standing while addressing a golf ball with the fitting ball club. LCC is a tabular listing of sets of incremental measurements, each set comprising possible incremental LCC measurements to be combined with a standard length.

BRIEF DESCRIPTION OF THE DRAWINGS

Other advantages and further features of the present invention are explained in conjunction with the following drawings illustrating the present invention:

FIG. 4 is a schematic illustration of the fitting chart according to the present invention;

DESCRIPTION OF THE PREFERRED EMBODIMENTS

Figure 1:
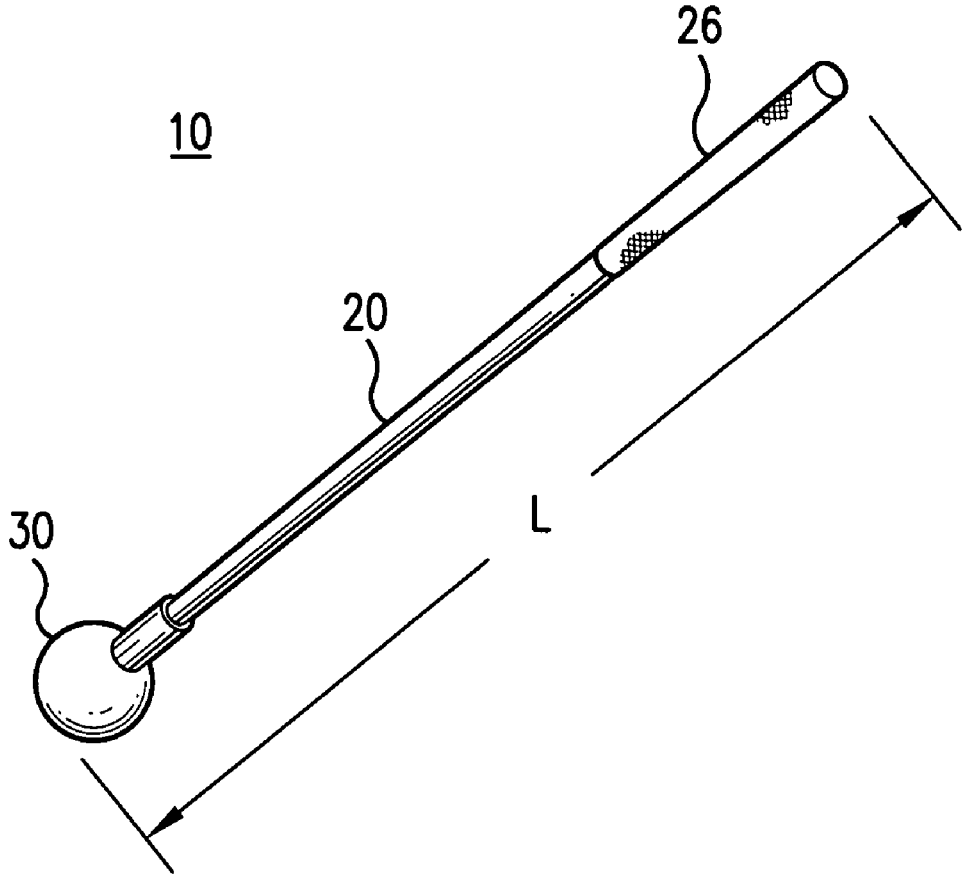
FIG. 1 is a partially schematic perspective view of a fitting ball club according to the present invention.

FIG. 1 is a partially schematic perspective view of one embodiment of a fitting ball club 10, including a fitting ball club shaft 20 having a fitting ball 30 attached thereto. Shaft 20 includes a grip 26. In a preferred embodiment, the total length L of the fitting ball club is about 37 and ¼ inches.

Figure 2A:
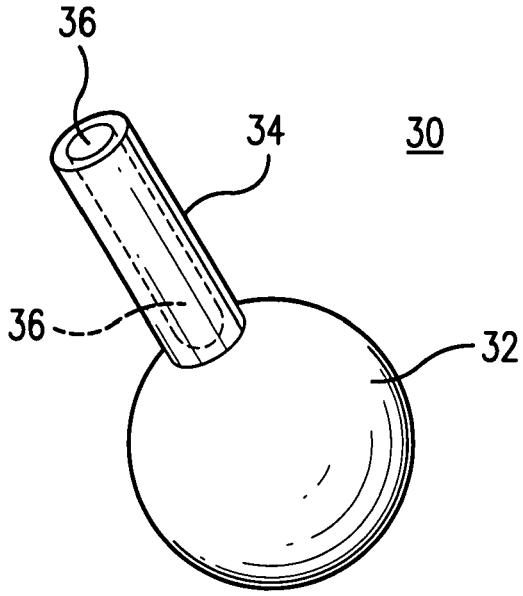
FIGS. 2A and 2B are partially schematic views of a fitting ball according to the present invention.

FIG. 2A is a partially schematic view of a fitting ball 30 including a ball portion 32 and a protruding hosel 34 for receiving a shaft end 24 of a fitting ball club shaft 20. The spherical shape of the ball portion 32 has no distinct bottom surface that would act like the sole of a golf club. If such a sole-like bottom surface was present, the visual and balance aspects of the ball 32 might influence the golfer's hand position on the fitting ball club shaft 20 during club length fitting.

As shown in FIG. 2A, a hosel 34 is connected with ball portion 32, and has a cylindrical bore 36 for receiving the end of a fitting ball club shaft 20. A suitable adhesive can be used to fix the shaft in the hosel 34.

Figure 2B:
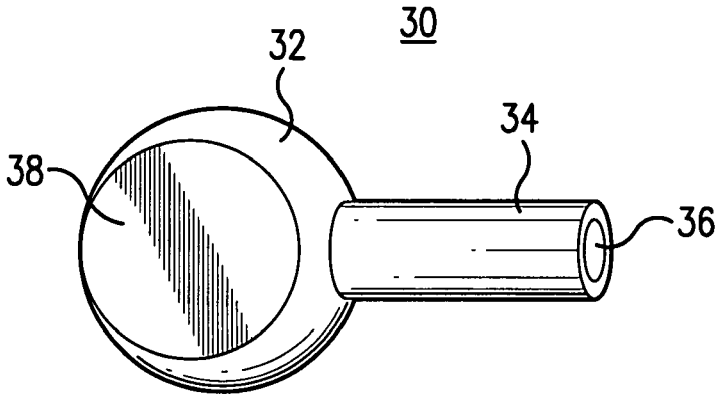
Figure 3A:
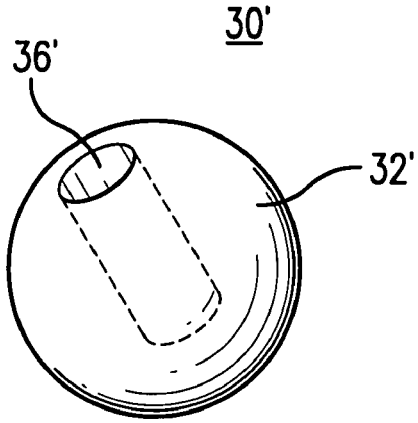
FIGS. 3A and 3B are partially schematic views of another fitting ball according to the present invention.
Figure 3B:
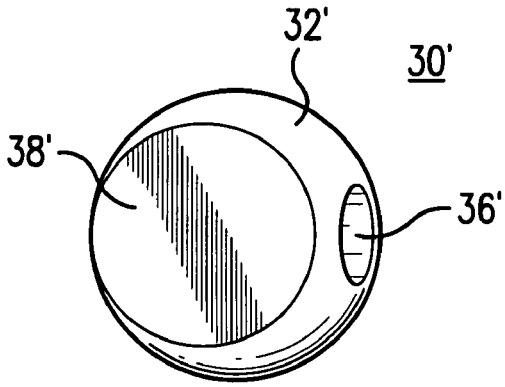

FIG. 2B is another view of the fitting ball 30 of FIG. 2A, showing a chordal sector-like flat face 38 for positioning adjacent a golf ball by a golfer addressing a golf ball with such a fitting ball club 10 during club length fitting. Flat face 38 is designed not to have any loft like a golf club face, so that flat face 38 is not significantly visible to a golfer holding a fitting ball club while addressing a golf ball during club length fitting.

FIG. 4 is a chart of fitting data in columns headed Player Height (PH), Wrist-to-Floor Measurement (WFM), and Length of Control Club (LCC).

In the Player Height (PH) column is a tabular listing of a plurality of possible ranges of heights, while standing erect, of a golfer to be fitted.

Figure 5A:
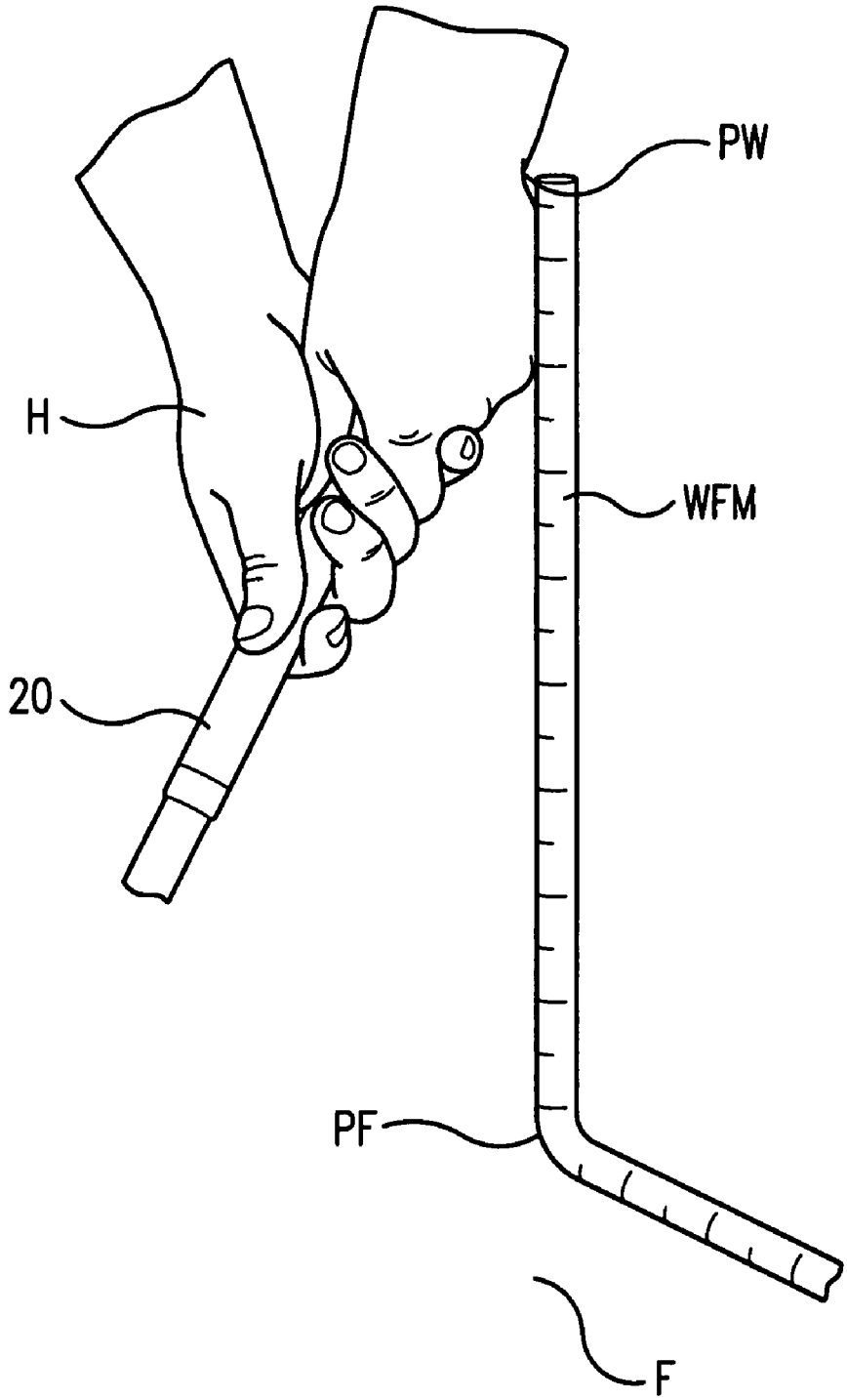
FIG. 5A is a schematic partial view of a golfer's hands gripping the fitting ball club according to the present invention.
Figure 5B:
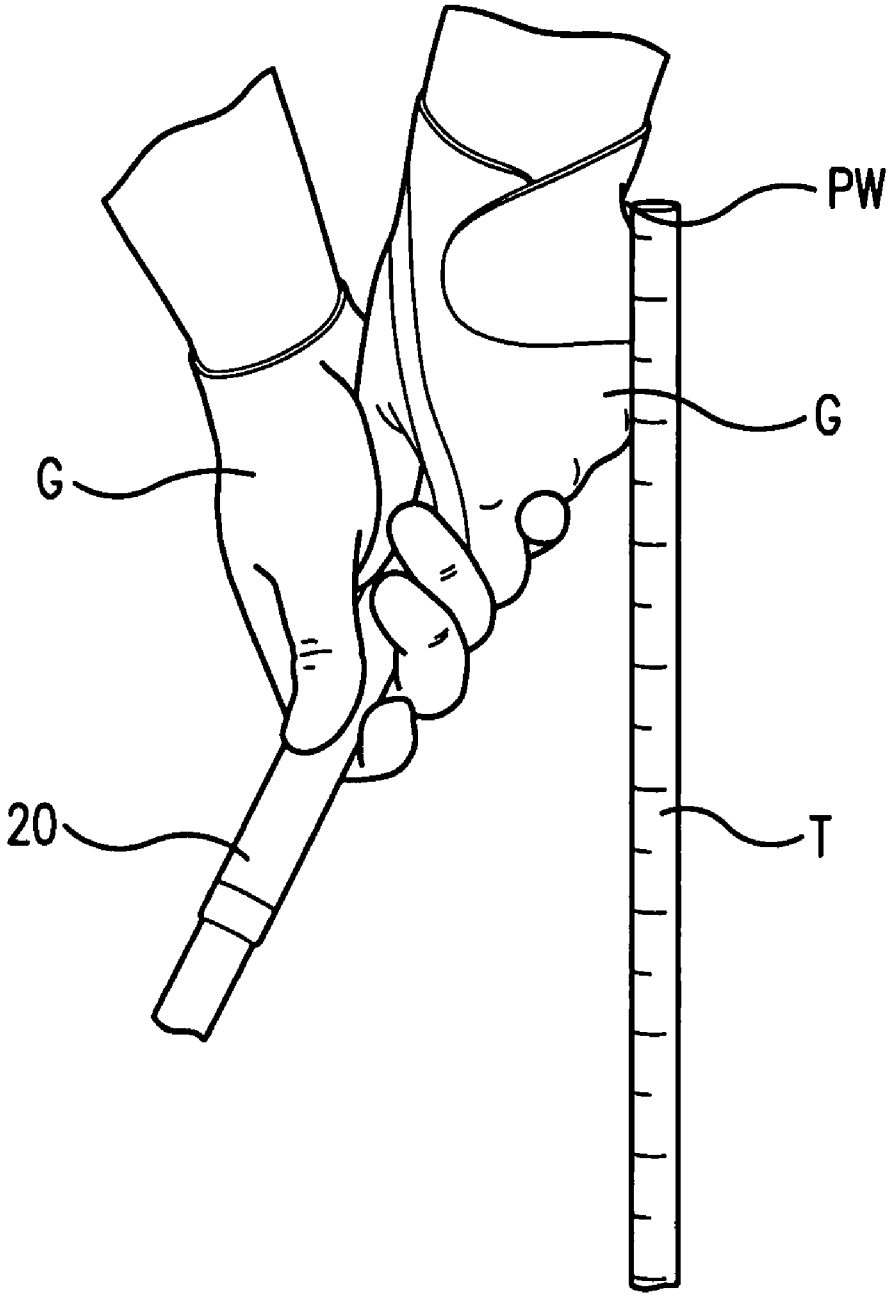
FIG. 5B is an arrangement alternative to FIG. 5A, showing a golfer's hands wearing gloves.

In the Wrist-to-Floor Measurement (WPM) column is a tabular listing of sets of possible WFMs, each WFM set corresponding to one of the PH ranges, wherein each WFM set is a plurality of possible WFM distances between a predetermined point PW on a wrist of such a golfer and a point PF vertically beneath such wrist point PW on a floor on which a golfer is standing while addressing a golf ball with a fitting ball club, as shown in FIGS. 5A and 5B, described later herein.

In the Length of Control Club column is a tabular listing of sets of LCC incremental lengths, each LCC set comprising possible LCC length to be combined with the standard length L of the fitting ball club, wherein each possible LCC length correlates with a wrist to floor measurement WFM.

FIG. 5A is a partially schematic view of a golfer's hands H gripping a fitting ball club shaft 20 while addressing a golf ball (not shown). FIG. 5A shows the predetermined point PW at the wrist of the golfer being fitted and the point PF vertically beneath the wrist point PW on a floor F on which the golfer is standing while addressing a golf ball with a fitting ball club. Point PW is at the back-of-had/wrist junction of a golfer. A tape measure T is shown for measuring the vertical WFM distance between points PW and PF.

FIG. 5B is an alternative view to that of FIG. 5A, showing a golfer's left hand wearing a glove G while gripping a fitting ball club shaft 20. The predetermined wrist point PW is in this instance at the edge of the golf glove worn by the golfer.

Preferably, the length of the fitting ball club is not revealed to the golfer being fitted. Revealing the length could influence the golfer to hold the fitting ball club for an imagined club length or club number in a set of irons. For example, if the golfer thinks that he or she is holding a number six iron, then the golfer might set up with a posture different than if the club length were unknown. Preferably the golfer should be asked to simulate comfortable address position used with a mid-iron. No swinging is necessary.

The method according to the present invention for prescribing a desired club length for iron-type golf clubs for a specific golfer comprises obtaining PH and WFM measurement data from the golfer to be fitted, identifying corresponding data in the PH and WFM columns of the FIG. 4 fitting chart, and deriving a recommended club length from the LCC data in the third column of the FIG. 4 table.

A simple calculation is made for determining a recommended shaft length by adding the derived LCC increment to the standard length L of 37-¼ inches. This results in a recommended overall club length for a mid-iron among a set of iron-type golf clubs.

If the golfer prefers to emphasize distance, the calculated shaft length may be increased by one-half inch. If the golfer prefers to emphasize accuracy of ball placement, the calculated shaft length may be decreased by one-half inch.

What is claimed is:

1. A method for prescribing overall club length for iron-type golf clubs for an individual player, said method comprising:

measuring the erect height (PH) of a player to be fitted;

providing the player with a fitting ball club (FBC) comprising:

a spherical ball having a hosel bore therein, a golf club shaft one end of which is in said hosel bore and connected to said spherical ball, and a golf club grip on the other end of said shaft;

having the player hold the fitting ball club in address position as if about to hit a golf ball therewith;

measuring the wrist-to-floor measurement (WFM) vertically from the player's higher wrist to the floor therebelow;

using data corresponding to the PH and WFM measurements, respectively, for the player and;

deriving an incremental length LCC and adding that incremental LCC length to 37-½ inches, thereby giving a prescribed overall club length for that player.

2. The method of claim 1 additionally comprising increasing the prescribed overall club length by one-half inch for increasing ball flight distance.

3. The method of claim 1 additionally comprising decreasing the prescribed overall club length by one-half inch for increasing ball flight accuracy.

* * * * *